US011649140B2

(12) United States Patent
Maruyama et al.

(10) Patent No.: US 11,649,140 B2
(45) Date of Patent: May 16, 2023

(54) RAIL INSTALLATION ASSIST DEVICE, RAIL INSTALLATION ASSIST METHOD, RAIL INSTALLATION ASSIST SYSTEM, AND COMPUTER PROGRAM PRODUCT

(71) Applicant: TOSHIBA ELEVATOR KABUSHIKI KAISHA, Kawasaki (JP)

(72) Inventors: Yutaka Maruyama, Tokorozawa Saitama (JP); Yoshihiko Nakada, Tokyo (JP); Yasufumi Takakusaki, Tokyo (JP); Yoshinobu Ishikawa, Tokyo (JP)

(73) Assignee: Toshiba Elevator Kabushiki Kaisha, Kawasaki (JP)

( * ) Notice: Subject to any disclaimer, the term of this patent is extended or adjusted under 35 U.S.C. 154(b) by 3 days.

(21) Appl. No.: 17/520,986

(22) Filed: Nov. 8, 2021

(65) Prior Publication Data

US 2022/0144593 A1 May 12, 2022

(30) Foreign Application Priority Data

Nov. 10, 2020 (JP) ..... JP2020-187234

(51) Int. Cl.
*B66B 19/00* (2006.01)
*B66B 7/02* (2006.01)

(52) U.S. Cl.
CPC ..... *B66B 19/002* (2013.01); *B66B 7/024* (2013.01)

(58) Field of Classification Search
CPC ..... B66B 7/027; B66B 7/023; B66B 7/024; B66B 19/002
See application file for complete search history.

(56) References Cited

U.S. PATENT DOCUMENTS 5,214,947 A * 6/1993 Sissala ..... B66B 19/002 72/17.3
6,128,116 A * 10/2000 Dobler ..... G01S 5/16 398/1
8,302,319 B1 * 11/2012 Chen ..... G01C 15/004 33/286
9,718,643 B2 * 8/2017 van der Meijden .. B66B 7/1246
11,235,954 B2 * 2/2022 Cambruzzi ..... B66B 19/00
(Continued)

FOREIGN PATENT DOCUMENTS

JP H01-321285 A 12/1989
JP H04-055276 A 2/1992
(Continued)

*Primary Examiner* — Michael A Riegelman
(74) *Attorney, Agent, or Firm* — Foley & Lardner LLP

(57) ABSTRACT

A rail installation assist device includes at least control circuitry. The control circuitry is configured to acquire displacement information representing displacement of individual rail brackets and a rail joint from a reference position, the rail brackets that fix guide rails in an elevator shaft, the rail joint that joins the guide rails together; estimate, from the displacement information, a change in the displacement information of the rail brackets and the rail joint when the rail brackets are moved to given target positions; calculate an evaluation value for variation in the displacement information before the change and an evaluation value for variation in the displacement information after the change; and set positions of the rail brackets based on a result of comparison between the evaluation values.

8 Claims, 6 Drawing Sheets

(56) References Cited

U.S. PATENT DOCUMENTS

| | | | | |
|---|---|---|---|---|
| 2007/0170013 | A1* | 7/2007 | Rivera | B66B 7/024 187/408 |
| 2009/0120734 | A1* | 5/2009 | Barneman | B66B 19/002 187/408 |
| 2009/0266651 | A1* | 10/2009 | Van Der Meijden | B66B 19/00 52/741.1 |
| 2014/0138189 | A1* | 5/2014 | van der Meijden | B66B 5/0087 187/406 |
| 2015/0360913 | A1* | 12/2015 | Fernandez | G01D 5/2006 187/408 |
| 2016/0311658 | A1* | 10/2016 | Kilpeläinen | B66B 19/002 |
| 2016/0311659 | A1* | 10/2016 | Mertala | E04G 3/246 |
| 2019/0106296 | A1* | 4/2019 | Barneman | B66B 19/00 |
| 2019/0367328 | A1* | 12/2019 | Cambruzzi | B32B 37/00 |
| 2020/0055709 | A1* | 2/2020 | Cambruzzi | B66B 19/002 |
| 2020/0377339 | A1* | 12/2020 | Cambruzzi | G01C 15/004 |
| 2021/0016996 | A1* | 1/2021 | Makinen | B66B 7/023 |
| 2021/0016998 | A1* | 1/2021 | Haag | B66B 19/002 |
| 2021/0238011 | A1* | 8/2021 | Haag | B66B 7/024 |
| 2022/0144593 | A1* | 5/2022 | Maruyama | B66B 19/002 |
| 2022/0282768 | A1* | 9/2022 | Maruyama | H01F 1/44 |

FOREIGN PATENT DOCUMENTS

| | | | |
|---|---|---|---|
| JP | H05-097349 | A | 4/1993 |
| JP | H05-105362 | A | 4/1993 |
| JP | H07-242379 | A | 9/1995 |
| JP | H08-059133 | A | 3/1996 |
| JP | 2603740 | B2 | 4/1997 |
| JP | 6545862 | B1 | 7/2019 |
| JP | 6579595 | B1 | 9/2019 |

* cited by examiner

RAIL INSTALLATION ASSIST DEVICE, RAIL INSTALLATION ASSIST METHOD, RAIL INSTALLATION ASSIST SYSTEM, AND COMPUTER PROGRAM PRODUCT

CROSS-REFERENCE TO RELATED APPLICATIONS

This application is based upon and claims the benefit of priority from Japanese Patent Application No. 2020-187234, filed on Nov. 10, 2020; the entire contents of which are incorporated herein by reference.

FIELD

Embodiments described herein relate generally to a rail installation assist device, a rail installation assist method, a rail installation assist system, and a computer program product.

BACKGROUND

Traditionally, installation work of elevator guide rails in a building includes an alignment process for aligning the guide rails in a line. In such an alignment process, it is typical to adjust the guide rails to extend in a straight line with reference to a piano line vertically suspended in the elevator shaft. Specifically, in the alignment process, rail brackets serving to secure the guide rails to the building are placed in a vertical line along the reference line to adjust the guide rails to extend in a line along the reference line.

Meanwhile, the elevator shaft height is longer than the standard length of a guide rail, therefore, it is necessary to join the guide rails together at rail joints to meet the shaft height. Any of the joined portions at the rail joints may be cracked or broken when applied with force by hammering or the like in the alignment process. Thus, even if the rail brackets become aligned in a line in the alignment process, the guide rails may not extend in a straight line due to the crack or break in the joined portion.

Moreover, the alignment process is typically performed manually by a worker. The worker needs to perform the alignment while considering and determining how adjusting one location affects another location. This may increase the number of man-hours of the alignment process depending on the skill level of the worker.

It is thus preferable to provide a rail installation assist device, a rail installation assist method, a rail installation assist system, and a computer program product which can perform an alignment process efficiently and accurately.

DETAILED DESCRIPTION

Figure 1:
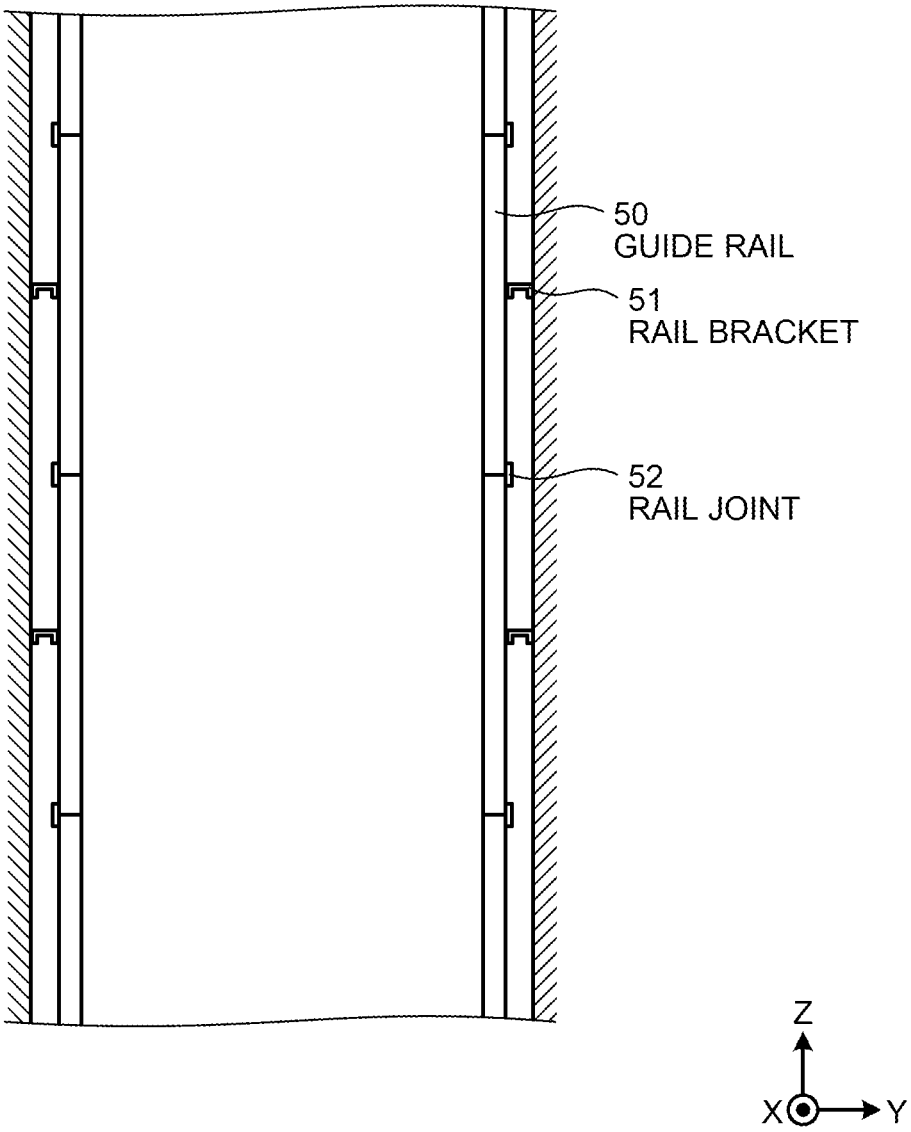
FIG. 1 is a diagram for explaining a guide rail installation method according to an embodiment.

According to one embodiment, in general, a rail installation assist device includes at least control circuitry. The control circuitry is configured to: acquire displacement information representing displacement of individual rail brackets and a rail joint from a reference position, the rail brackets that fix guide rails in an elevator shaft, the rail joint that joins the guide rails together; estimate, from the displacement information, a change in the displacement information of the rail brackets and the rail joint when the rail brackets are moved to given target positions; calculate an evaluation value for variation in the displacement information before the change and an evaluation value for variation in the displacement information after the change; and set positions of the rail brackets based on a result of comparison between the evaluation values.

Hereinafter, a rail installation assist device, a rail installation assist method, a rail installation assist system, and a computer program product according to some embodiments will be described with reference to the accompanying drawings. In the following embodiments, same or like elements or components will be denoted by the same reference numerals and an overlapping explanation thereof will be omitted.

First, with reference to FIG. 1, a guide rail installation method according to an embodiment is described. FIG. 1 is a diagram for explaining a guide rail installation method according to an embodiment. FIG. 1 illustrates an elevator shaft as viewed from the front. In FIG. 1 a vertical direction is defined as a Z-direction, a direction orthogonal to the Z-direction is defined as an X-direction, and a direction orthogonal to the X-direction and Z-direction is defined as a Y-direction, which represent triaxial Cartesian coordinates.

As illustrated in FIG. 1, two columns of guide rails 50 are placed along an elevator shaft. Each column of the guide rails 50 is formed by joining two or more guide rails 50 together vertically (in Z-axis direction). Each of the guide rails 50 is secured to the walls of a building with a rail bracket 51, for example.

Specifically, the rail brackets 51 are, for example, fixed to the building with fasteners such as bolts in the vertical direction. Although FIG. 1 illustrates one rail bracket 51 for one guide rail 50 by way of example, two or more rail brackets 51 may be provided for one guide rail 50.

The vertically neighboring guide rails 50 are joined together with rail joints 52. Specifically, each rail joint 52 is fixed to the two vertically neighboring guide rails 50 with bolts and nuts, for example, to join the two guide rails 50 together. Thus, the elevator shaft height at the uppermost floor of the elevator is implemented by joining the guide rails 50 with the rail joints 52.

The elevator runs along the guide rails 50, therefore, improperly installed or not straight guide rails 50 may cause vibrations on the running elevator car, leading to deteriorating passengers' comfortability in the elevator. In view of this, the installation process of the guide rails 50 includes a rail adjustment such as an alignment process in which the guide rails 50 are adjusted to be in alignment.

In the traditional alignment process the guide rails 50 are adjusted to be in a line with reference to a piano line vertically suspended with respect to the elevator shaft. Specifically, in the alignment process the rail brackets serving to secure the guide rails to the building are placed in a vertical line along the reference line to adjust the guide rails to extend in a line along the reference line.

In the elevator shaft, however, the guide rails 50 are joined together with the rail joints 52, as described above. Thus, any of the joined portions at the rail joints 52 may be cracked or broken, when applied with a force arising from the alignment process. Because of this, even if the rail brackets 51 become aligned in a line in the alignment process, the guide rails 50 may not be able to extend in a line due to the crack or break in the joined portion at the rail joint 52.

In addition, the alignment process is typically performed by a worker manually. The worker needs to perform the alignment while considering and determining how adjusting one location affects another location, for example. This may increase the number of man-hours of the alignment process depending on the skill level of the worker.

In view of this, this disclosure intends to provide a tool that serves to execute a rail installation assist method for determining positions of the rail brackets 51 to allow the guide rails 50 to extend in a line without the necessity for aligning the rail brackets 51 in a line. However, this does not mean that the rail brackets 51 cannot be aligned in a line by the rail installation assist method. The guide rails 50 may extend most straight with the rail brackets 51 aligned in a line.

Figure 2:
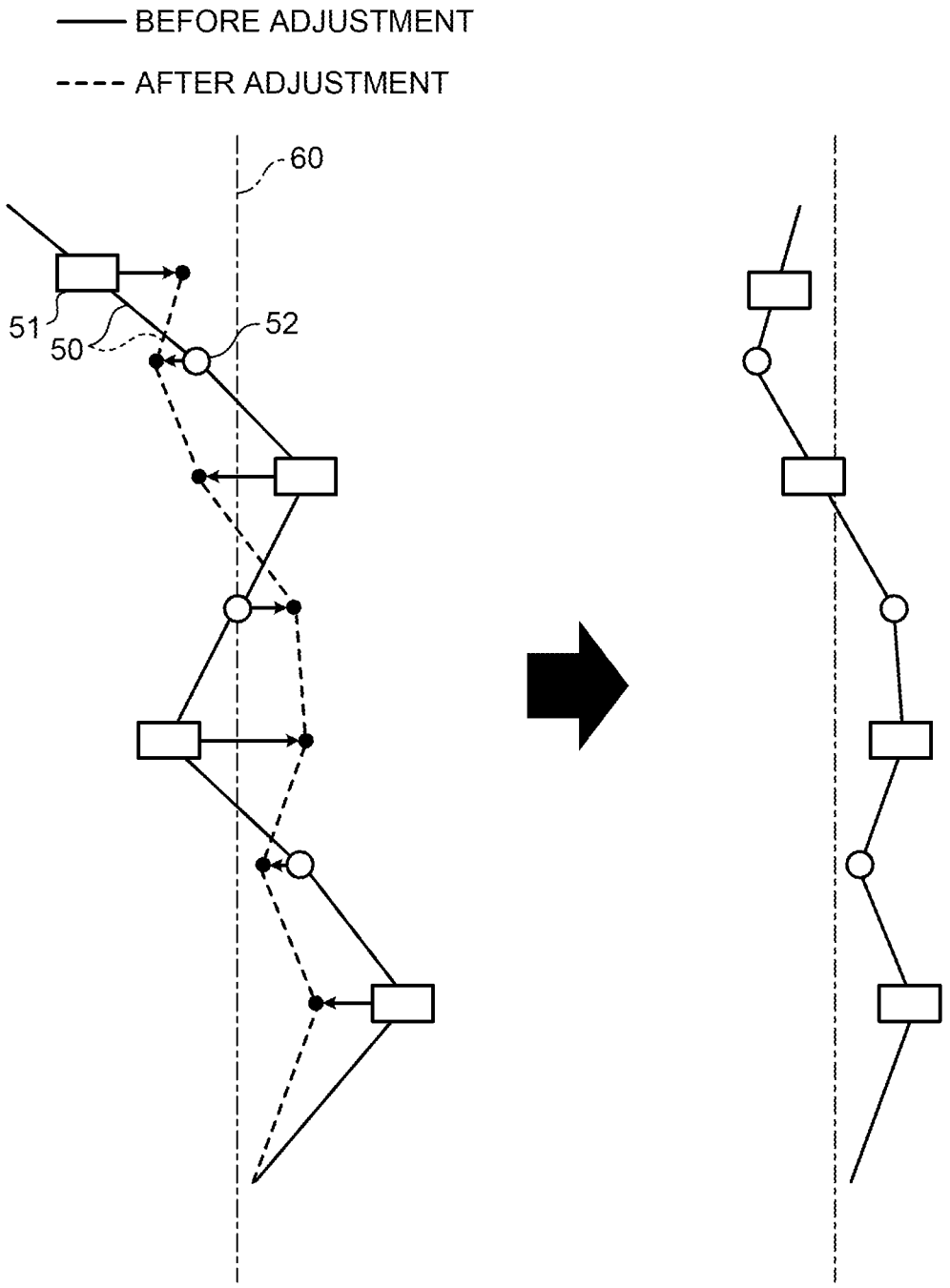
FIG. 2 is a diagram for explaining a rail installation assist method according to an embodiment.

With reference to FIG. 2, a rail installation assist method according to an embodiment will be described. FIG. 2 is a diagram for explaining the rail installation assist method of an embodiment. A summary of the rail installation assist method is described referring to FIG. 2, and details of the rail installation assist method will be described later.

In the left diagram of FIG. 2, the guide rails 50 before adjustment in the alignment process are indicated by the solid line while the guide rails 50 after adjustment are indicated by the broken line. In the right diagram of FIG. 2, only the guide rails 50 after adjustment, the rail brackets 51, and the rail joints 52 are illustrated. The guide rails 50 after adjustment refer to guide rails 50 adjusted in position with the rail brackets 51 positioned by the rail installation assist method of an embodiment.

Thus, according to the rail installation assist method, as illustrated in the right diagram of FIG. 2, the rail brackets 51 are not placed in a line but the positions of the rail brackets 51 are set such that variation in positions of the rail brackets 51 and the rail joints 52 with respect to a reference line 60 is to be a minimum. This consequently makes it possible to lessen misalignment of the guide rails 50 with respect to the reference line 60 without aligning the rail brackets 51 in a line. Note that the reference line 60 may be set on a drawing such as a blueprint or on the screen of a display 3 included in a rail installation assist device 1, or may be set to a piano-line positioned based on marking put by a construction company.

Specifically, the rail installation assist method of an embodiment first acquires displacement information representing positions of the rail brackets 51 and the rail joints 52. The displacement information refers to information representing displacement from the reference line 60 and is, for example represented by XYZ coordinates (see FIG. 1) with the reference line 60 set as the origin.

The rail installation assist method of an embodiment next generates an initial rail form (indicated by the solid line in the left diagram of FIG. 2) based on the displacement information as acquired. The rail installation assist method of an embodiment then calculates, by a rail behavior simulation, the behavior of the guide rails 50 when the rail brackets 51 are moved or adjusted from current positions to given target positions. The rail behavior simulation uses a simulation model, which is modeled by measuring or analyzing and recording in advance how each rail joint 52 and each rail bracket 51 are displaced along with a change in position of each rail bracket 51.

That is, by performing the rail behavior simulation using this simulation model, the worker is not required to actually adjust the rail brackets 51 to check the behavior of the guide rails 50. It is thus made possible to prevent an increase in man-hour of the alignment process and implement a stable alignment process irrespective of the skill level of the worker.

The rail installation assist method of an embodiment then estimates, through the rail behavior simulation, a change in the displacement information of the rail brackets 51 and the rail joints 52 when the rail brackets 51 are moved to the target positions.

The rail installation assist method of an embodiment then calculates an evaluation value for variation in the displacement information before the change and an evaluation value for variation in the displacement information after the change. An evaluation function for calculating the evaluation values can include, for example, a peak value of the displacement information of the rail brackets 51 (such as a distance from the rail bracket 51 furthest from the reference line 60 to the reference line 60) or a standard deviation in the distances to the rail brackets 51.

The rail installation assist method of an embodiment then sets the positions of the rail brackets 51 according to a result of comparison between the calculated evaluation values. Specifically, a pre-change evaluation value based on the displacement information before the change and a post-change evaluation value based on the displacement information before after the change are compared with each other to determine whether the post-change evaluation value has converged. That is, a determination as to whether displacement of the rail brackets 51 and the rail joints 52 with respect to the reference line 60 has fallen to a minimum is made.

After the post-change evaluation value has converged, the rail installation assist method determines the displacement information after the change, i.e., the target positions of the rail brackets 51, as final arrangement of the rail brackets 51 in the alignment process.

If the post-change evaluation value is not convergent, the rail behavior simulation is performed again repeatedly while the target positions of the rail brackets 51 are changed, until the post-change evaluation value becomes convergent.

In this manner the rail installation assist method of an embodiment makes it possible to set the positions of the rail brackets 51 so that the displacement of the rail brackets 51 and the rail joints 52 relative to the reference line 60 is to be a minimum. Thereby, the guide rails 50 can be accurately installed in a straight line.

Further, according to the rail installation assist method of an embodiment, the worker can know the final target positions of the rail brackets 51 by simply inputting the initial values of the displacement information of the rail brackets 51 and the rail joints 52. This can prevent increase in man-hour of the alignment process and variation in man-hour depending on the skill level of the worker.

Thus, the rail installation assist method of an embodiment can provide an efficient and accurate alignment process.

Further, the rail installation assist method of an embodiment can stably and accurately implement the alignment process irrespective of the skill level of the worker, which can facilitate securement of human resources for workers.

Further, the rail installation assist method of an embodiment is applicable not only to the installation work of the guide rails 50 but also to, for example, maintenance work such as a minor adjustment of part of the guide rails 50. This makes it possible for the worker to easily know how a minor adjustment of part of the guide rails 50 affects the other guide rails 50, contributing to improvement in efficiency and accuracy of the maintenance.

In addition the rail installation assist method can set the positions of the rail brackets 51 so that the elevator car traveling along the guide rails 50 is subjected to least vibration, which will be described later in detail.

Figure 3:
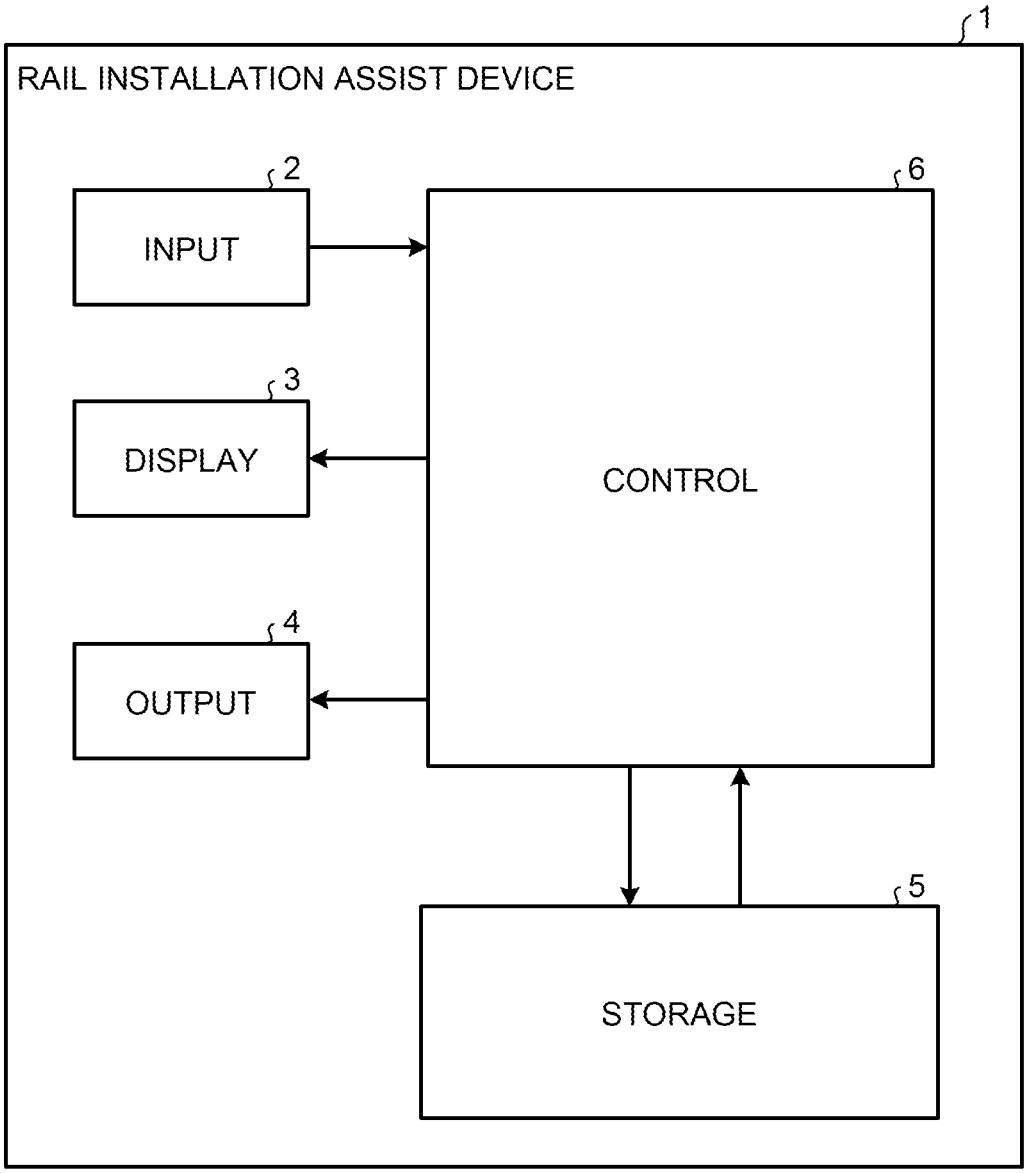
FIG. 3 is a block diagram illustrating an exemplary functional configuration of a rail installation assist device according to an embodiment.

The following will describe an exemplary functional configuration of the rail installation assist device 1 of an embodiment with reference to FIG. 3. FIG. 3 is a block diagram illustrating an exemplary functional configuration of the rail installation assist device 1 of an embodiment. Examples of the rail installation assist device 1 include but are not limited to a portable terminal device such as a smartphone, a tablet terminal, a laptop personal computer (PC), a desktop PC, a mobile phone, a personal digital assistant (PDA), and a wearable device.

The rail installation assist device 1 of an embodiment includes a microcomputer which includes at least a central processing unit (CPU; control circuitry), a read only memory (ROM) that pre-stores given control programs, a random access memory (RAM) that temporarily stores results of computation by the CPU, all of which are mutually connected via a bi-directional common bus of a general form. The rail installation assist device 1 functionally and conceptually includes an input 2, a display 3, a storage 5, and a control 6 by executing the control programs stored in the ROM, for example.

The rail installation assist device 1 further includes an output 4 functioning as an output port to which a portable storage medium is connectable. Specifically, the output 4 serves to output various kinds of information to the storage medium in accordance with an instruction from the control 6. The output 4 outputs, for example, a result of computation by the control 6, i.e., arrangement information as to positions of the rail brackets 51, to the storage medium. The arrangement information may be stored in another external device in place of the storage medium and be used as an operation command for a robot that performs the alignment process, for example.

The input 2 includes an input member that allows the worker to input various kinds of information. The input 2 serves to detect an operation of the input member such as a keyboard or a mouse, and output information based on the detected operation to the control 6, for example. The input 2 receives, for example, inputs of the initial values of the displacement information from the worker.

Alternatively, the input 2 may be connected to a sensor for sensing the displacement information, to be able to obtain the initial values of the displacement information from a sensor signal output from the sensor.

The display 3 includes, for example, a display device and else and functions to display information output from the control 6. The display 3 displays the arrangement information on positions of the rail brackets 51 output from the control 6, for example.

The storage 5 serves to store a variety of kinds of information output from the control 6. The storage 5 stores, for example, information such as the initial values of the displacement information input via the input 2 and results of computation by the control 6.

The control 6 serves to execute the rail installation assist method as described above.

Specifically, the control 6 first acquires the initial values of the displacement information of the rail brackets 51 and the rail joints 52, and stores the initial values in the storage 5. Alternatively, the initial values of the displacement information may be directly stored in storage 5 from the input 2 without using the control 6.

The displacement information represents displacement from the reference line 60 as described above, and is represented by the XYZ coordinates with the reference line 60 set as the origin, for example. Among the XYZ coordinates, Z-coordinates may be represented as a height from the ground being the origin. The displacement information is, however, not limited to the XYZ coordinates and may be represented by a vector indicating a direction and a distance with respect to the reference line 60.

The control 6 then generates an initial rail form of the guide rails 50 according to the acquired initial values of the displacement information. Also, the control 6 calculates evaluation values for variation in the displacement information from the initial values of the displacement information.

The evaluation function for calculating the evaluation values includes the displacement information as a variable and represents, for example, a peak value of the displacement information of the rail brackets 51 (such as a distance from the rail bracket 51 furthest from the reference line 60 to the reference line 60) or a standard deviation in the distances to the rail brackets 51. Alternatively, the evaluation function can be any function as long as it can represent variation in the displacement information, in addition to the peak value and standard deviation.

Next, the control 6 determines target positions of the rail brackets 51. Specifically, the control 6 determines by what amount the rail brackets 51 are to be displaced from the initial values of the displacement information. The target positions can be set in accordance with the evaluation values, for example. As for the rail bracket 51 with a highest peak value, for example, the control 6 sets the target position such that the peak value lowers. For another example, as to the rail bracket 51 with a highest (or lowest) standard deviation value, the control 6 sets the target position such that the standard deviation lowers. The number of the rail brackets 51 whose target positions are set may be one or two or more.

In addition, all of the rail brackets 51 may be handled as variables (i.e., displacement information is variable) or displacement information of part of the rail brackets 51 may be handled as a constant, for example. Handling the displacement information as a constant signifies that the rail bracket or brackets 51 in question is/are not subjected to the alignment process. This is suitable, for example, for the situation such that part of the rail brackets 51 may interfere with another member, if moved in the alignment process, therefore, cannot be moved.

Further, in the case of handling all the rail brackets 51 as variables but adjusting part of the rail brackets 51, for example, the target positions of only the part of the rail brackets 51 in question may be set. This can eliminate the necessity for the worker to manually re-adjust the rest of the rail brackets 51 in order to adjust part of the rail brackets 51. Thereby, the worker's adjustment work can be reduced to a minimum.

The target positions may be set in accordance with the evaluation values, or any of the rail brackets 51 may be set to any target position randomly. In a latter case, if the post-change evaluation value deteriorates at the randomly set target position as described later, this target position may be changed to an opposite positon next time.

Alternatively, the target positions may be set as close to an optimal solution as possible, with reference to information on the work history of another installation site, for example. The target positions may be set for a specific purpose such as shifting the position of the entire guide rails 50.

The control 6 next calculates, by the rail behavior simulation, the behavior of the guide rails 50 when the rail brackets 51 are moved from the current positions to the target positions. The rail behavior simulation uses a simulation model, which is modeled by measuring or analyzing and recording in advance how each rail joint 52 and each rail bracket 51 are displaced along with a change in position of each rail bracket 51.

The control 6 next estimates, through the rail behavior simulation, a change in the displacement information of the rail brackets 51 and the rail joints 52 when the rail brackets 51 are moved to the target positions.

The control 6 then calculates the evaluation values based on the displacement information after the estimated change. The control 6 determines whether post-change evaluation values based on the displacement information after change are convergent by comparing pre-change evaluation values (i.e., initial values) based on the displacement information before change and the post-change evaluation values.

Specifically, when the post-change evaluation values become convergent, the control 6 determines the displacement information after change, i.e., the target positions of the rail brackets 51, as the final arrangement of the rail brackets 51 in the alignment process.

Meanwhile, if the post-change evaluation values are not convergent, the control 6 performs the rail behavior simulation again repeatedly while changing the target positions of the rail brackets 51, until the post-change evaluation values become convergent (that is, the post-change evaluation values stop decreasing further).

Specifically, if the previous post-change evaluation values increase by a next rail behavior simulation, the control 6 determines that the previous post-change evaluation values have been convergent.

The control 6 next determines the target positions of the rail brackets 51 at the time the evaluation values become convergent, as the final arrangement of the rail brackets 51 in the alignment process. The control 6 causes the display 3 to display arrangement information on the positions of the rail brackets 51 as determined, and/or stores the arrangement information in an external storage medium via the output 4 or in the storage 5.

Thus, the control 6 enables the worker to easily recognize irregularity in the rail brackets 51 at the current positions by simply checking the arrangement information of the rail brackets 51 stored in the storage 5 or another storage during maintenance.

Figure 4:
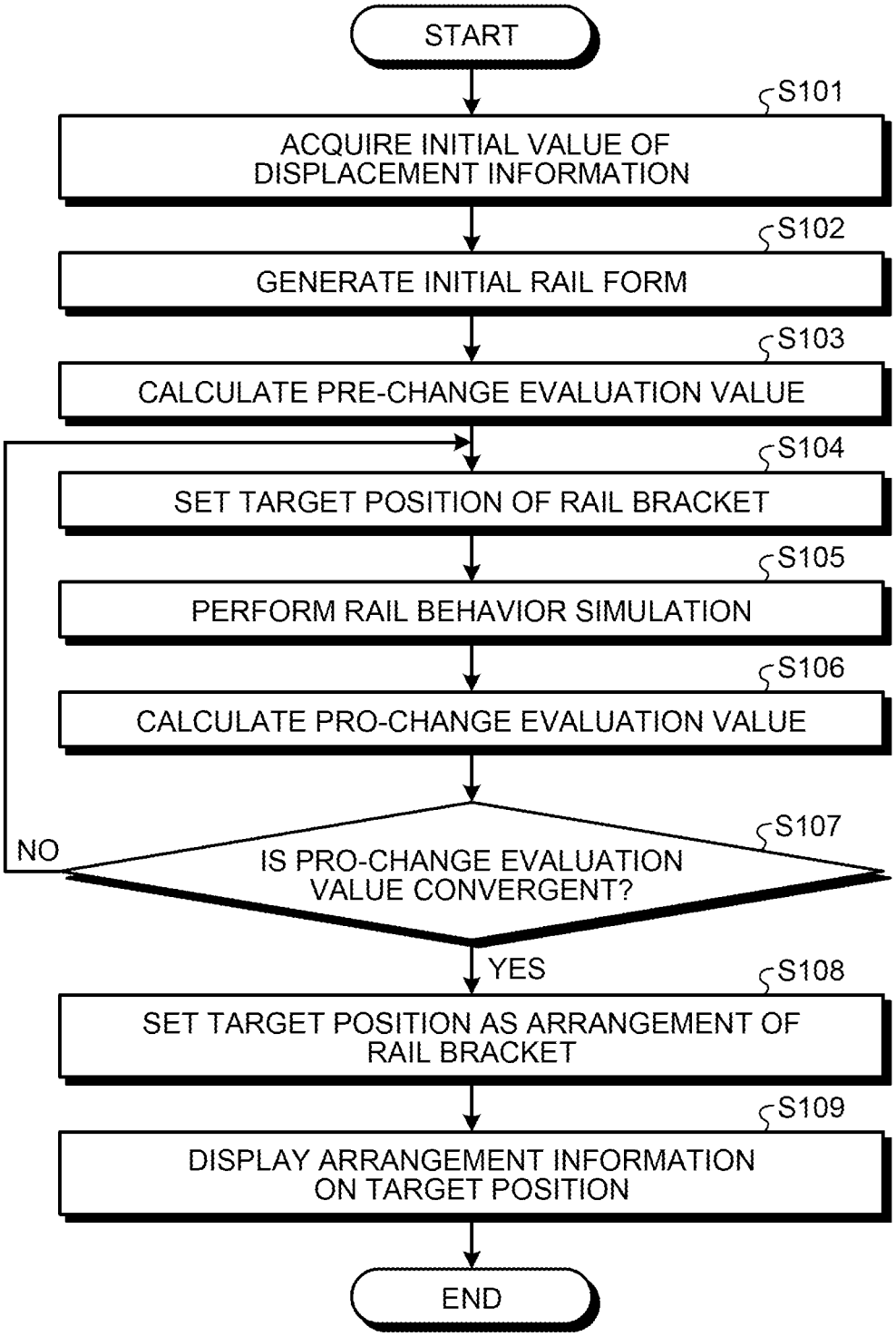
FIG. 4 is a flowchart illustrating an exemplary operation procedure by the rail installation assist device in an embodiment.

The following will describe exemplary processing of the rail installation assist device 1 of an embodiment with reference to FIG. 4. FIG. 4 is a flowchart illustrating an exemplary operation procedure of the rail installation assist device 1.

As illustrated in FIG. 4, the control 6 of the rail installation assist device 1 acquires the initial values of displacement information of the rail brackets 51 and the rail joints 52 via the input 2 (step S101).

The control 6 generates an initial rail form of the guide rails 50 based on the displacement information as acquired (step S102). The control 6 then calculates pre-change evaluation values as a result of calculation of the evaluation function, by inputting the displacement information on the guide rails 50 of the initial rail form into the evaluation function (step S103).

The control 6 sets the target positions of the rail brackets 51 (step S104). The control 6 then performs a rail behavior simulation representing the behavior of the guide rails 50 when the rail brackets 51 are moved to the target positions (step S105).

The control 6 calculates post-change evaluation values based on the displacement information after change, which has been estimated from the behavior of the guide rails 50 resulting from the rail behavior simulation (step S106). The control 6 then determines whether the post-change evaluation values become convergent by comparing the post-change evaluation values and the pre-change evaluation values (step S107).

After determining that post-change evaluation values are convergent (YES in step S107), the control 6 sets the target positions as the final arrangement of the rail brackets 51 (step S108). The control 6 causes the display 3 to display information as to the target positions being the set arrangement of the rail brackets 51 (step S109), ending the processing.

If determining that the post-change evaluation values are not convergent in step S107 (NO in step S107), the control 6 performs step S104 again.

Modification

The above embodiments have described an exemplary method of setting positions of the rail brackets 51 to allow the guide rails 50 to extend in a straight line, without aligning the rail brackets 51 in a line. Alternatively, the rail brackets 51 may be positioned such that vibrations of the elevator car can be decreased, for example.

Specifically, the control 6 acquires elevator information representing specifications of the elevator via the input 2, in addition to the initial values of the displacement information. The elevator information includes travel speed, mass of the elevator car, spring constant between the elevator car and the guide rails 50, viscosity coefficient, and else.

The control 6 generates an elevator vibration model based on the elevator information. The vibration model refers to a model for obtaining the vibration of the traveling elevator car on the basis of the displacement (form) information of the guide rails 50. Specifically, the control 6 estimates vibration information as to the elevator car to be an output of the vibration model, by inputting the displacement information of the guide rails 50 into the vibration model.

In the case of standard-type elevators, the worker or another personnel may select one or some vibration models from pre-generated vibration models according to the elevator information.

The control 6 then calculates a vibration evaluation value (pre-change evaluation value) using an evaluation function to which vibration information based on the displacement information is input. The evaluation function for calculating the vibration evaluation value may represent, for example, a peak value of vibration waveforms, root mean square (RMS) value, or 95% average. That is, the evaluation function may be any function for calculating a physical quantity to serve as a vibration evaluation index.

The control 6 then sets the target positions of the rail brackets 51. The target positions may be set in accordance with the evaluation value or any of the rail brackets 51 may be set to any target position randomly. The control 6 calculates, by the rail behavior simulation, the behavior of the guide rails 50 when the rail brackets 51 are moved from the current positions to the target positions.

The control 6 next performs a simulation using a vibration model on the basis of the displacement information after change, to estimate vibration information based on the displacement information after change. The control 6 calculates a vibration evaluation value (post-change evaluation value) by inputting the estimated vibration information into the evaluation function. The control 6 compares the pre-change evaluation value and the post-change evaluation value to determine whether the post-change evaluation value is convergent.

Specifically, after determining that the post-change evaluation value is convergent, the control 6 determines the displacement information after change, that is, the target positions of the rail brackets 51, as the final arrangement of the rail brackets 51 in the alignment process.

If the post-change evaluation value is not convergent, the control 6 performs the rail behavior simulation again while changing the target positions of the rail brackets 51 and the simulation using the vibration model repeatedly until the post-change evaluation value becomes convergent (i.e., the post-change evaluation value stops decreasing further). Thereby, it is possible to implement the alignment process such that the vibrations of the elevator car are to be a minimum.

The control 6 then determines the target positions of the rail brackets 51 at the time the evaluation value becomes convergent as the final arrangement. The control 6 causes the display 3 to display arrangement information on the positions of the rail brackets 51 as determined, and/or stores the arrangement information in an external storage medium via the output 4 or in the storage 5.

In this disclosure, the positions of the rail brackets 51 may be set in accordance with both or either of the evaluation values for variation in the displacement information and the vibration evaluation value.

Figure 5:
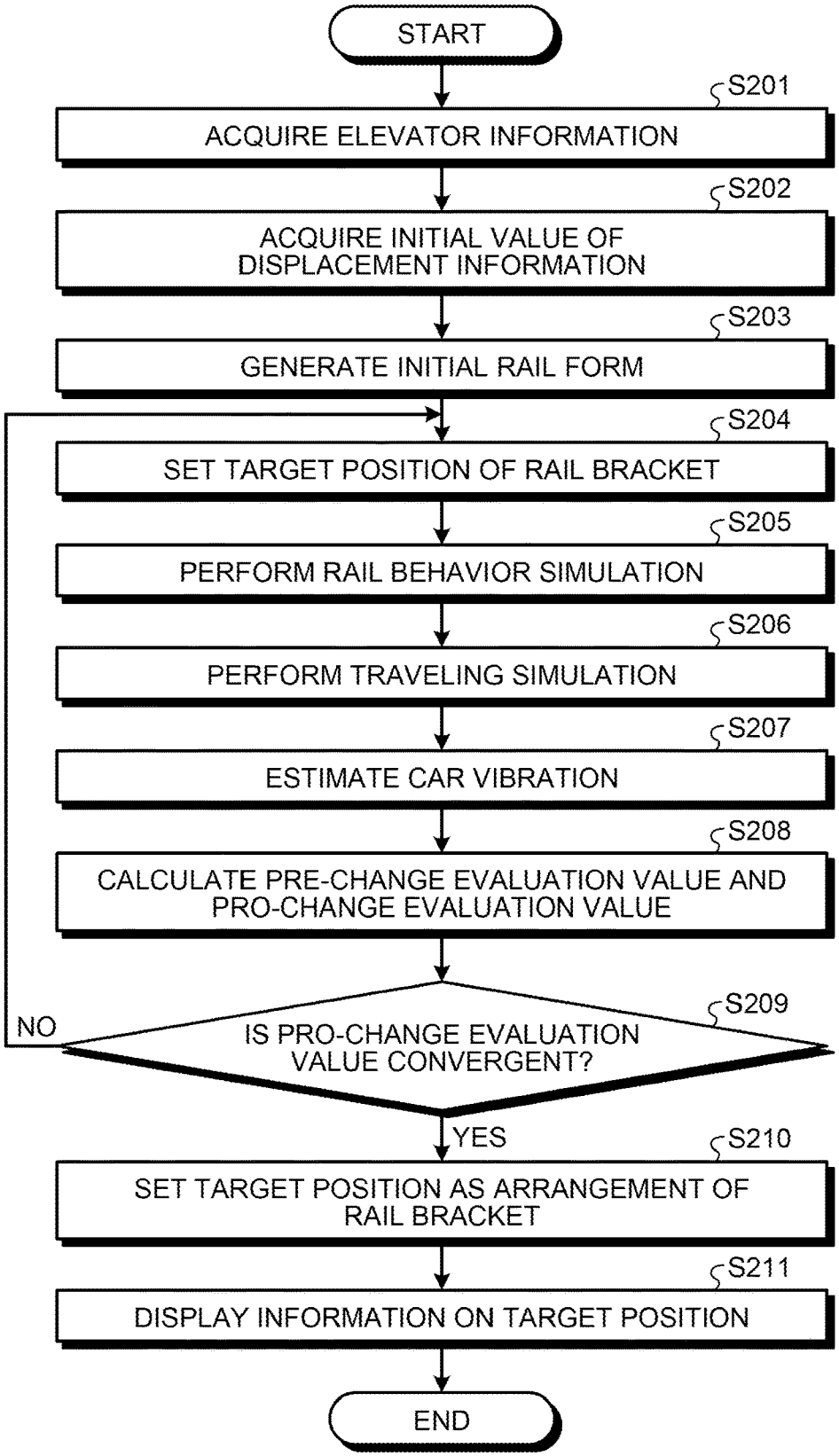
FIG. 5 is a flowchart illustrating an exemplary operation procedure by a rail installation assist device according to a modification.

The following will describe exemplary processing of a rail installation assist device 1 according to a modification. FIG. 5 is a flowchart illustrating an exemplary operation procedure of the rail installation assist device 1 according to a modification.

As illustrated in FIG. 5, the control 6 acquires elevator information as to specifications of the elevator (step S201). The control 6 next acquires the initial values of displacement information of the rail brackets 51 and the rail joints 52 via the input 2 (step S202).

The control 6 generates an initial rail form of the guide rails 50 based on the displacement information as acquired (step S203).

The control 6 sets the target positions of the rail brackets 51 (step S204). The control 6 then performs the rail behavior simulation of the guide rails 50 when the rail brackets 51 are moved to the target positions (step S205).

The control 6 performs a traveling simulation based on the rail form resulting from the rail behavior simulation and the elevator information (step S206). The control 6 calculates a car vibration representing vibration waveforms of the elevator car from a result of the traveling simulation (step S207). The control 6 then calculates a pre-change evaluation value and a post-change evaluation value for the vibration waveforms of the car vibration (step S208), and determines whether or not the post-change evaluation value is convergent (step S209).

After determining that the post-change evaluation value is convergent (YES in step S209), the control 6 sets the target positions as the final arrangement of the rail brackets 51 (step S210). The control 6 then causes the display 3 to display the arrangement information on the target positions being the set arrangement of the rail brackets 51, ending the processing (step S211).

If determining that the post-change evaluation value is not convergent (No in step S209), the control 6 performs step S204 again.

The above embodiments have described an example that the rail installation assist device 1 performs all the processing from receiving the initial values of the displacement information to setting the positions of the rail brackets 51. Alternatively, a server device may be provided to perform part of the processing of the rail installation assist device 1, for example.

Figure 6:
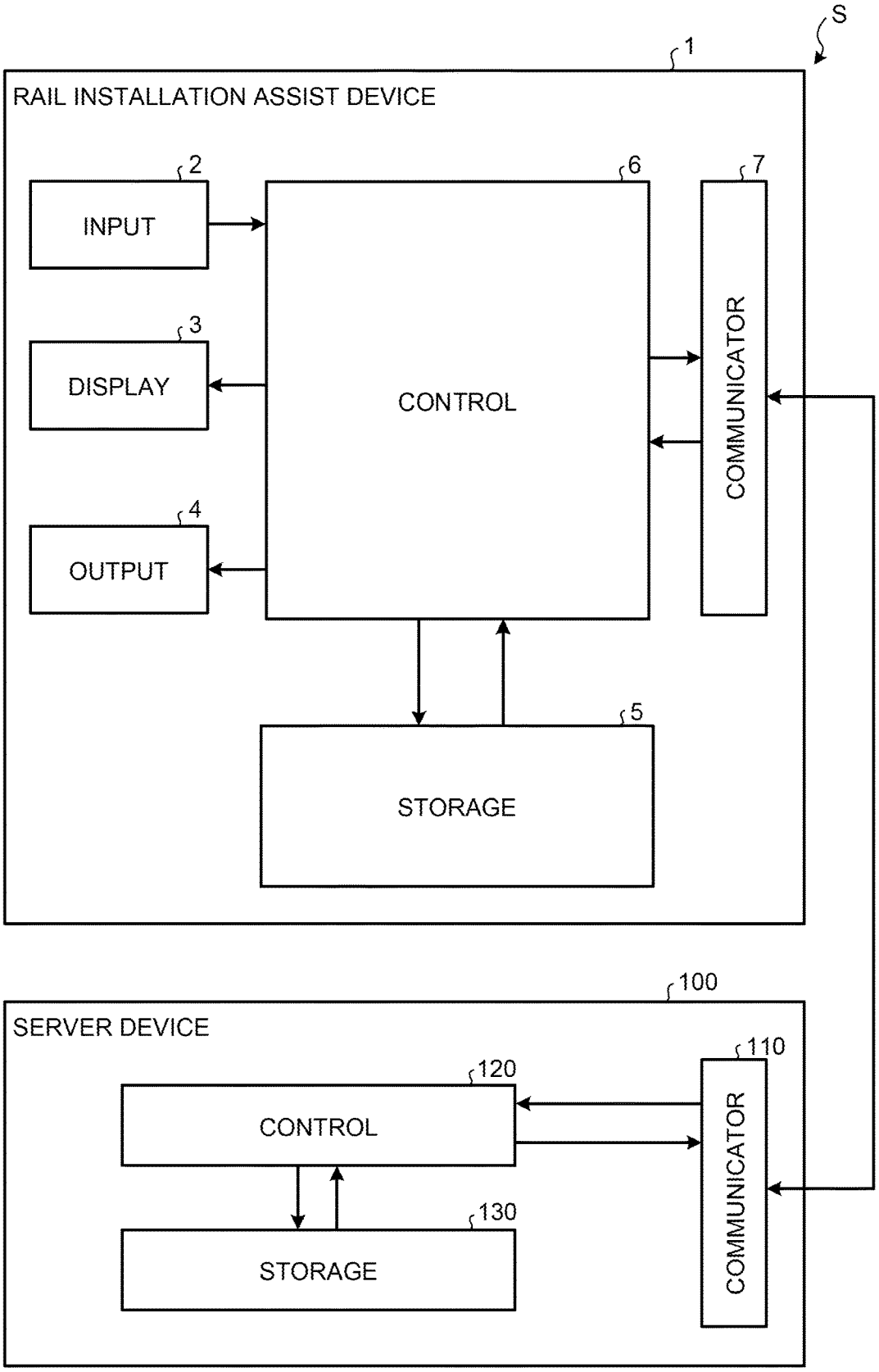
FIG. 6 a block diagram illustrating an exemplary configuration of a rail installation assist system according to a modification.

In this regard, a rail installation assist system will be described with reference to FIG. 6. FIG. 6 is a block diagram illustrating an exemplary configuration of a rail installation assist system according to a modification.

As illustrated in FIG. 6, a rail installation assist system S includes a rail installation assist device 1 and a server device 100. Note that same or like functional elements of the rail installation assist device 1 as those of the above embodiments will not be described.

As illustrated in FIG. 6, the rail installation assist device 1 further includes a communicator 7. The communicator 7 serves to establish communications with the server device 100 via a given communication network. The communication network is, for example, for 3G, long term evolution (LTE), 4G, or 5G communications.

The server device 100 includes a microcomputer which includes at least a central processing unit (CPU; control circuitry), a read only memory (ROM) that pre-stores given control programs, a random access memory (RAM) that temporarily stores results of computation by the CPU, all of which are mutually connected via a bi-directional common bus of a general form. The server device 100 functionally and conceptually includes a communicator 110, a control 120, and a storage 130 by executing the control programs stored in the ROM, for example.

In the rail installation assist system S, the control 6 of the rail installation assist device 1 serves to acquire the initial values of displacement information via the input 2, transmit the initial values to the server device 100 via the communicator 7, acquire arrangement information on the rail brackets 51 being results of computation from the server device 100, and cause the display 3 to display the arrangement information, for example.

That is, the control 6 of the rail installation assist device 1 performs processing other than processing for setting the positions of the rail brackets 51.

The control 120 of the server device 100 serves to perform processing for setting the positions of the rail brackets 51. Specifically, the control 120 sets the target positions, performs the rail behavior simulation and the traveling simulation, and calculates and compares the evaluation values to set the positions of the rail brackets 51, as in the above embodiments or modifications.

In other words, in the rail installation assist system S the rail installation assist device 1 handles simpler (i.e., less processing load) computation while the server device 100 handles computation with greater processing load. Thereby, the control 120 of the server device 100, which incorporates the high-end CPU capable of large-scale computation, can implement higher-speed, larger-quantity computation, therefore, the rail installation assist system S can set the positions of the rail brackets 51 more quickly and more accurately.

Using 5G communications, in particular, the rail installation assist system S is able to substantially shorten the processing time as a whole.

As described above, the rail installation assist device 1 of some embodiments includes at least the control 6. The control 6 acquires displacement information representing displacement of the individual rail brackets 51, which fix the guide rails 50 in the elevator shaft, and of the individual rail joints 52, which join the guide rails 50 together, from the reference position (reference line 60). The control 6 estimates, from the displacement information as acquired, a change in the displacement information of the rail brackets 51 and the rail joints 52 when the rail brackets 51 are moved to given target positions. The control 6 calculates an evaluation value for variation in the displacement information before the change and an evaluation value for variation in the displacement information after the change. The control 6 sets positions of the rail brackets 51 based on a result of comparison between the calculated evaluation values. Thereby, the rail installation assist device 1 of some embodiments can set the positions of the rail brackets 51 to allow the guide rails 50 to extend in a straight line without aligning the rail brackets 51 in a line, to be able to efficiently and accurately perform the alignment process.

Further, in the rail installation assist device 1 of some modifications the control 6 estimates vibrations to occur on the elevator car when travelling along the guide rails 50 of a rail form which is based on each of the displacement information before change and the displacement information after change. The control 6 calculates vibration evaluation values for the estimates of vibrations based on the respective items of displacement information before and after change, to set the positions of the rail brackets 51 based on a result of comparison between the vibration evaluation values as calculated. Thereby, the rail installation assist device 1 of some modifications can provide optimal comfortability to passengers in the elevator, in addition to attaining the same or like effects as the rail installation assist device 1 of some embodiments.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A rail installation assist device, comprising at least control circuitry configured to:

acquire displacement information representing displacement of individual rail brackets and a rail joint from a reference position, the rail brackets that fix guide rails in an elevator shaft, the rail joint that joins the guide rails together;

estimate, from the displacement information, a change in the displacement information of the rail brackets and the rail joint when the rail brackets are moved to given target positions;

calculate an evaluation value for variation in the displacement information before the change and an evaluation value for variation in the displacement information after the change; and set positions of the rail brackets based on a result of comparison between the evaluation values.

2. A rail installation assist method to be performed by a rail installation assist device comprising at least control circuitry, the method comprising:

by the control circuitry, acquiring displacement information representing displacement of individual rail brackets and a rail joint from a reference position, the rail brackets that fix guide rails in an elevator shaft, the rail joint that joins the guide rails together;

estimating, from the displacement information, a change in the displacement information of the rail brackets and the rail joint when the rail brackets are moved to given target positions;

calculating an evaluation value for variation in the displacement information before the change and an evaluation value for variation in the displacement information after the change; and setting positions of the rail brackets based on a result of comparison between the evaluation values.

3. The rail installation assist method according to claim 2, further comprising:

by the control circuitry, estimating vibration to occur on an elevator car when travelling along the guide rails of a rail form which is based on each of the displacement information before the change and the displacement information after the change;

calculating a vibration evaluation value for an estimate of the vibration based on the displacement information before the change and a vibration evaluation value for an estimate of the vibration based on the displacement information after the change; and setting positions of the rail brackets based on a result of comparison between the vibration evaluation values.

4. The rail installation assist method according to claim 2, wherein each of the guide rails is provided with a plurality of rail brackets that fixes the guide rails in the elevator shaft, and at least part of the displacement information of each of the plurality of rail brackets represents a constant.

5. The rail installation assist method according to claim 2, further comprising:

causing, by the control circuitry, a display to display arrangement information on the positions of the rail brackets.

6. A rail installation assist method to be performed by a rail installation assist device comprising at least control circuitry, the method comprising:

by the control circuitry, acquiring displacement information representing displacement of individual rail brackets and a rail joint from a reference position, the rail brackets that fix guide rails in an elevator shaft, the rail joint that joins the guide rails together;

estimating, from the displacement information, a change in the displacement information of the rail brackets and the rail joint when the rail brackets are moved to given target positions;

estimating vibration to occur on an elevator car when travelling along the guide rails of a rail form which is based on each of the displacement information before the change and the displacement information after the change;

calculating a vibration evaluation value for an estimate of the vibration based on the displacement information before the change and a vibration evaluation value for an estimate of the vibration based on the displacement information after the change; and setting positions of the rail brackets based on a result of comparison between the vibration evaluation values.

7. A rail installation assist system, comprising:

a rail installation assist device comprising at least control circuitry; and a server device comprising at least control circuitry, wherein the server device and the rail installation assist device are communicably connected to each other, wherein the control circuitry of the rail installation assist device, configured to:

acquire displacement information representing displacement of individual rail brackets and a rail joint from a reference position, the rail brackets that fix guide rails in an elevator shaft, the rail joint that joins the guide rails together, and transmit the displacement information to the server device, the control circuitry of the server device, configured to:

estimate, from the displacement information received from the rail installation assist device, a change in the displacement information of the rail brackets and the rail joint when the rail brackets are moved to given target positions, calculate an evaluation value for variation in the displacement information before the change and an evaluation value for variation in the displacement information after the change, set positions of the rail brackets based on a result of comparison between the evaluation values, and transmit the positions of the rail brackets to the rail installation assist device.

8. A computer program product comprising a non-transitory computer readable medium including programmed instructions as to rail installation assist, wherein the instructions, when executed by a computer, cause the computer to execute:

acquiring displacement information representing displacement of individual rail brackets and a rail joint from a reference position, the rail brackets that fix guide rails in an elevator shaft, the rail joint that joins the guide rails together;

estimating, from the displacement information, a change in the displacement information of the rail brackets and the rail joint when the rail brackets are moved to given target positions;

calculating an evaluation value for variation in the displacement information before the change and an evaluation value for variation in the displacement information after the change; and setting positions of the rail brackets based on a result of comparison between the evaluation values.

* * * * *